US005428429A

United States Patent [19]

Fletcher

[11] Patent Number: 5,428,429

[45] Date of Patent: Jun. 27, 1995

[54] RESISTIVE INTERMEDIATE TRANSFER MEMBER

[75] Inventor: Gerald M. Fletcher, Pittsford, N.Y.

[73] Assignee: Xerox Corporation, Stamford, Conn.

[21] Appl. No.: 811,866

[22] Filed: Dec. 23, 1991

[51] Int. Cl.[6] ..... G03G 15/00

[52] U.S. Cl. ..... 355/272; 355/271; 355/274

[58] Field of Search ..... 355/272, 274, 277, 271, 355/276, 275

[56] References Cited

U.S. PATENT DOCUMENTS

| | | | |
|---|---|---|---|
| 3,830,589 | 8/1974 | Allen | 355/274 |
| 3,832,053 | 8/1974 | Goel et al. | 355/274 |
| 3,890,040 | 6/1975 | Schmidlin | 355/212 |
| 4,292,386 | 9/1981 | Takano | 430/63 |
| 4,341,455 | 7/1982 | Fedder | 355/274 |
| 4,401,383 | 8/1983 | Suzuki et al. | 355/272 |
| 4,494,857 | 1/1985 | Ueno et al. . | |
| 4,931,839 | 6/1990 | Tompkins et al. . | |
| 4,984,024 | 1/1991 | Ohkaji et al. | 355/273 |
| 4,994,342 | 2/1991 | Nakayama et al. | 430/49 |
| 5,101,239 | 3/1992 | Nishikawa et al. | 355/274 |

FOREIGN PATENT DOCUMENTS

| | | | |
|---|---|---|---|
| 3117210 | 2/1982 | Germany | 355/275 |
| 0049974 | 3/1983 | Japan | 355/275 |
| 0104673 | 6/1984 | Japan | 355/274 |
| 0206567 | 9/1987 | Japan | 355/275 |
| 0121878 | 5/1989 | Japan | 355/275 |
| 2206533 | 1/1989 | United Kingdom | 355/275 |

*Primary Examiner*—A. T. Grimley
*Assistant Examiner*—Thu Anh Dang
*Attorney, Agent, or Firm*—Denis A. Robitaille

[57] ABSTRACT

An apparatus for enabling a laterally conductive, resistive backed photoconductive intermediate transfer member in an electrophotographic printing apparatus. The printing apparatus includes a toner transfer system having an intermediate transfer belt comprising a laterally conductive resistive substrate with a pre-transfer grounding device and a transfer charging device. A ground potential bias is applied to the intermediate transfer belt prior to entering a transfer nip region to generate low transfer fields therein. Subsequently, the laterally conductive resistive layer of the intermediate surface is provided with a biasing voltage, generating high transfer fields in the transfer nip. In an alternative embodiment, a post-transfer bias is applied to the intermediate transfer belt for substantially enhancing the transfer fields in the transfer nip.

6 Claims, 4 Drawing Sheets

RESISTIVE INTERMEDIATE TRANSFER MEMBER

The present invention relates generally to a system for transfer of charged toner particles in an electrostatographic printing apparatus, and more particularly concerns an apparatus for enabling an intermediate transfer member having a laterally conductive resistive backing substrate.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing material is subsequently deposited onto the photoreceptive member such that the developing material is attracted to the charged image areas on the photoconductive surface thereof to develop the electrostatic latent image into a visible image. The developing material is then transferred from the photoreceptive member, either directly or after an intermediate transfer step, to a copy sheet or other support substrate, creating an image which may be permanently affixed to the copy sheet to provide a reproduction of the original document. In a final step, the photoconductive surface of the photoreceptive member is cleaned to remove any residual developing material thereon in preparation for successive imaging cycles.

The described electrostatographic copying process is well known and is commonly used for light lens copying of an original document. Analogous processes also exist in other electrostatographic printing applications such as, for example, ionographic printing and reproduction, where charge is deposited in an image pattern on a charge retentive surface in response to electronically generated or stored images as described in U.S. Pat. Nos. 3,564,556; 4,240,084; and 4,619,515 among others.

The process of transferring developing material from an image support surface to a second supporting surface is realized at a transfer station. In a conventional transfer station, transfer is achieved by applying electrostatic force fields in a transfer region sufficient to overcome forces which hold the toner particles to the photoconductive surface on the photoreceptive member. These electrostatic force fields operate to attract and transfer the toner particles over onto the second supporting surface which may be an intermediate transfer belt or an output copy sheet. An intermediate transfer belt is desirable for use in tandem color or one pass paper duplex (OPPD) applications where successive toner powder images are transferred onto a single copy sheet. For example, U.S. Pat. No. 3,957,367 issued to Goel, the disclosure of which is incorporated herein by reference, teaches a color electrostatographic printing machine wherein successive single-color powder images are transferred to an intermediary, in superimposed registration with one another. The resultant multi-layered powder image is subsequently transferred to a sheet of support material to form a color copy of an original document. Color and OPPD systems may also utilize multiple photoconductive drums in lieu of a single photoconductive drum.

Intermediate transfer elements employed in imaging systems of the type in which a developed image is first transferred from the imaging member to an intermediate member and then transferred from the intermediate to an outer copy substrate should exhibit efficient transfer characteristics both for transfer of the developer material from the imaging member to the intermediate as well as for transfer of the developer material from the intermediate to the output copy substrate. Efficient transfer occurs when most or all of the developer material comprising the developed image is transferred and little residual developer remains on the surface from which the image was transferred. Highly efficient transfer is particularly important when the imaging process entails the creation of full color images by sequentially generating and developing successive images in each primary color and superimposing the developed primary color images onto each other during transfer to the substrate. In particular, undesirable shifting and variation in final colors produced can occur when the primary color images are not efficiently transferred to the substrate.

Transfer of toner images between support surfaces in electrostatographic applications is often accomplished via electrostatic induction using a corotron or other corona generating device. In corona induced transfer systems, the second supporting surface, an intermediate support member or a copy sheet is placed in direct contact with the toner image while the image is supported on the image bearing surface (typically a photoconductive surface). Transfer is induced by spraying the back of the second supporting surface with a corona discharge having a charge polarity opposite that of the toner particles, thereby inducing electrostatic transfer of the toner particles to the second supporting surface. An exemplary corotron ion emission transfer system is disclosed in U.S. Pat. No. 2,807,233. Alternatively, transfer can be induced by applying a potential difference between the substrate of a biased member contacting the second supporting member and the substrate of the image bearing surface originally supporting the toner image layer.

The critical aspect of the transfer process focuses on applying and maintaining high intensity electrostatic fields in the transfer region in order to overcome the adhesive forces acting on the toner particles. Careful control of these electrostatic fields is required to induce the physical detachment and transfer-over of the charged particulate toner materials from one surface to a second supporting surface without scattering or smearing of the developer material. This difficult requirement can be met by carefully tailoring the electrostatic fields across the transfer region so that the fields are high enough to effect efficient toner transfer while being low enough so as not to cause arcing, excessive corona generation, or excessive toner transfer in the regions prior to intimate contact of the second supporting surface and the toner image. Imprecise and inadvertent manipulation of these electrostatic fields can create copy or print defects by inhibiting toner transfer or by inducing uncontrolled toner transfer, causing scattering or smearing of the toner particles.

The specific problems associated with successful image transfer are well known. Variations in conditions, such as second supporting surface resistivity, contaminants, and changes in the toner charge or in the adhesive properties of the toner materials, can all effect necessary transfer parameters. Further, material resistivity and toner properties can change greatly with humidity and other ambient environmental parameters. In the pre-transfer or so called pre-nip region, immediately in advance of contact between the second supporting surface and the developed image, excessively high transfer fields can result in premature transfer across an air gap, leading to decreased resolution or blurred images. High transfer fields in the pre-nip air gap can also cause ionization which may lead to strobing or other image defects, loss of transfer efficiency, and a lower latitude of system operating parameters. Conversely, in the post-transfer or so called post-nip region, at the photoconductor/second supporting surface separation area, insufficient transfer fields can cause image dropout and may generate hollow characters. Also, improper ionization in the post-nip region may cause image stability defects or can create copy sheet detacking problems. Inducement of variations in desirable field strength across the transfer region must be balanced against the basic premise that the transfer fields should be as large as possible in the region directly adjacent to the transfer nip where the second supporting surface contacts the developed image so that high transfer efficiency and stable transfer can be achieved.

In intermediate transfer systems, conductive backed belts are typically desired because such conductive materials allow for simple generation of transfer fields via applied biases (e.g., BTR systems). The use of conductive materials is also desirable to maintain charge uniformity patterns. Finally, highly conductive materials, such as steel, nickel, etc., typically used for intermediate transfer applications tend to be very sturdy, non-stretch materials. This characteristic is desirable and important for maintaining proper registration in single-pass intermediate belt configurations.

A typical problem encountered with the use if highly conductive backed materials in intermediate transfer belt systems arises from the fact that the highly conductive backing is an equipotential. Thus, a bias applied to a conductive backed belt in the transfer nip will generate undesirable transfer fields away from the nip, and particularly in the pre-transfer region where pre-nip breakdown and air gap transfer can cause toner splatter and other image quality defects. Although electrostatic fields typically drop substantially in the pre-nip transfer zone relative to the transfer nip, seemingly minimal pre-nip fields can cause significant transfer problems. Further, nominal pre-nip fields under normal conditions can translate to poor system robustness relative to environmental or parameter changes such as high humidity, toner adhesive, pile height, etc.

Various approaches and solutions to the problems inherent to the transfer process and specifically related to systems including an intermediate transfer member have been proposed. The following disclosures may be relevant to various aspects of the present invention:

U.S. Pat. No. 4,292,386 Patentee: Takano Issued: Sep. 29, 1981

U.S. Pat. No. 4,494,857 Patentee: Euno et al. Issued: Jan. 22, 1985

U.S. Pat. No. 4,931,839 Patentee: Tompkins et al. Issued: Jun. 5, 1990

U.S. Pat. No. 4,994,342 Patentee: Nakayama et al. Feb. 19, 1991

The relevant portions of the foregoing disclosures may be briefly summarized as follows:

U.S. Pat. No. 4,292,386 discloses a photosensitive drum comprising a hollow cylinder having a conductive layer formed on the outer periphery of the hollow cylinder, a low resistance layer formed on the outer periphery of the conductive layer, and a photosensitive layer formed on the outer peripheral surface of the low resistance layer.

U.S. Pat. No. 4,494,857 discloses an imaging method using a charged insulating layer comprising a process which includes a first step for bringing a pliable contactor having a specific electric resistance into contact with the insulating layer, and a second step for impressing a voltage on the contactor in contact with the insulating layer by means of an electrode having another specific resistance.

U.S. Pat. No. 4,931,389 describes a transfer mechanism for a full color, double transfer electrophotographic print engine. An image receiving web has a characteristic surface resistivity which falls within the range of $10^7$ to $10^{10}$ ohms/square. A selectively operable system is used to increase dwell time in the transfer station, yielding the effect of increasing the effective capacitance of the transfer station. The combination of lower applied voltages and proper selection of the surface resistivity of the image receiving web provides a system wherein direct application of the electric field through web contacts can be used, thus eliminating coronas and the consequent performance variations.

U.S. Pat. No. 4,994,342 discloses an electrophotographic lithographic printing plate precursor comprising an undercoating layer and a backing layer, both having a resistive surface.

In accordance with the present invention, an apparatus for transferring toner from an image support surface to a substrate is provided, wherein an intermediate transfer member is positioned to have at least a portion thereof adjacent the image support surface to define a transfer zone including a pre-transfer zone, a transfer nip, and a post-transfer zone and means, located adjacent said pre-transfer zone, are provided for establishing a first voltage potential on the intermediate transfer member in the pre-transfer zone while means, located adjacent the transfer zone, are provided for establishing a second voltage potential on the intermediate transfer member in the transfer nip. Means, located adjacent the post-transfer zone may also be provided for establishing a third voltage potential on the intermediate transfer belt in the post-transfer zone. The intermediate transfer belt includes a laterally conductive resistive substrate having a resistivity range between approximately $10^7$ and $10^{11}$ ohms/square.

In another aspect of the invention, an electrostatographic printing apparatus is disclosed, comprising a transfer assembly for transferring toner from an image support surface to a copy substrate wherein the transfer apparatus includes an intermediate transfer member positioned to have at least a portion thereof adjacent the image support substrate to define a pre-transfer zone, a transfer zone, and a post-transfer zone and means, located adjacent said pre-transfer zone, are provided for establishing a first voltage potential on the intermediate transfer member in the pre-transfer zone while means, located adjacent the transfer nip, are provided for establishing a second voltage potential on the intermediate transfer member in the transfer nip.

In yet another aspect of the invention, an apparatus for transferring charged toner particles from an image support surface to a sheet is disclosed, comprising an intermediate transfer member being adapted to receive toner particles from the image support surface and to transfer the toner particles therefrom to the sheet, wherein the intermediate transfer member includes a laterally conductive resistive substrate having a resistivity range between approximately $10^7$ and $10^{10}$ ohms/-square.

These and other aspects of the present invention will become apparent from the following description in conjunction with the accompanying drawings, in which.

Figure 1:
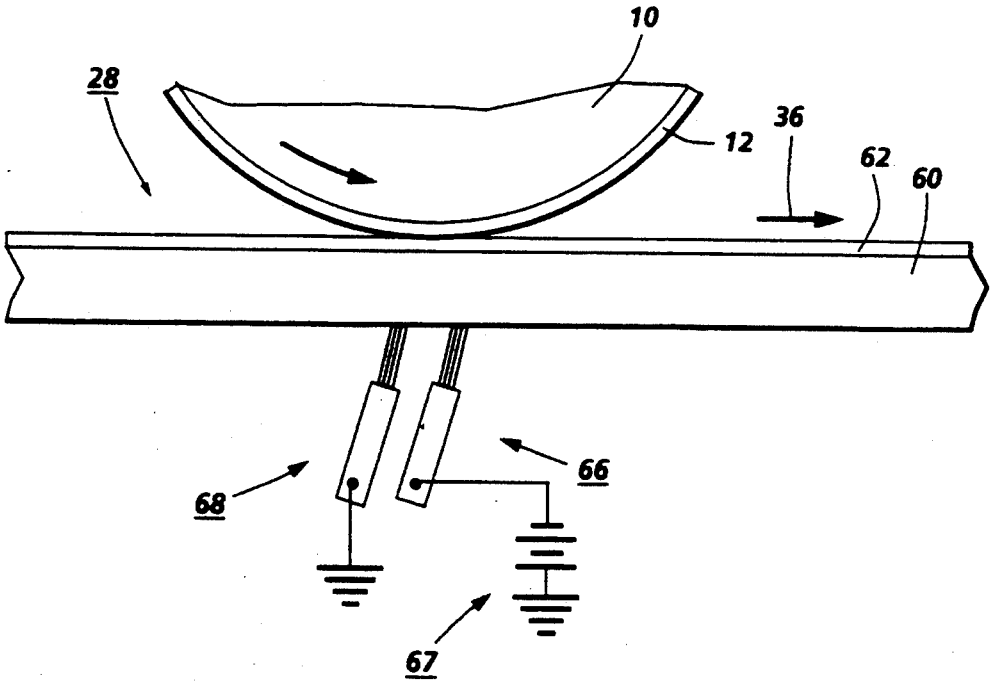
FIG. 1 is an enlarged schematic side view of a preferred embodiment of the transfer assembly of the present invention showing a pre-transfer biasing device and a transfer nip biasing device.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following detailed description progresses, with specific reference to the drawings wherein like reference numerals have been used throughout the drawings to designate identical elements therein.

Figure 5:
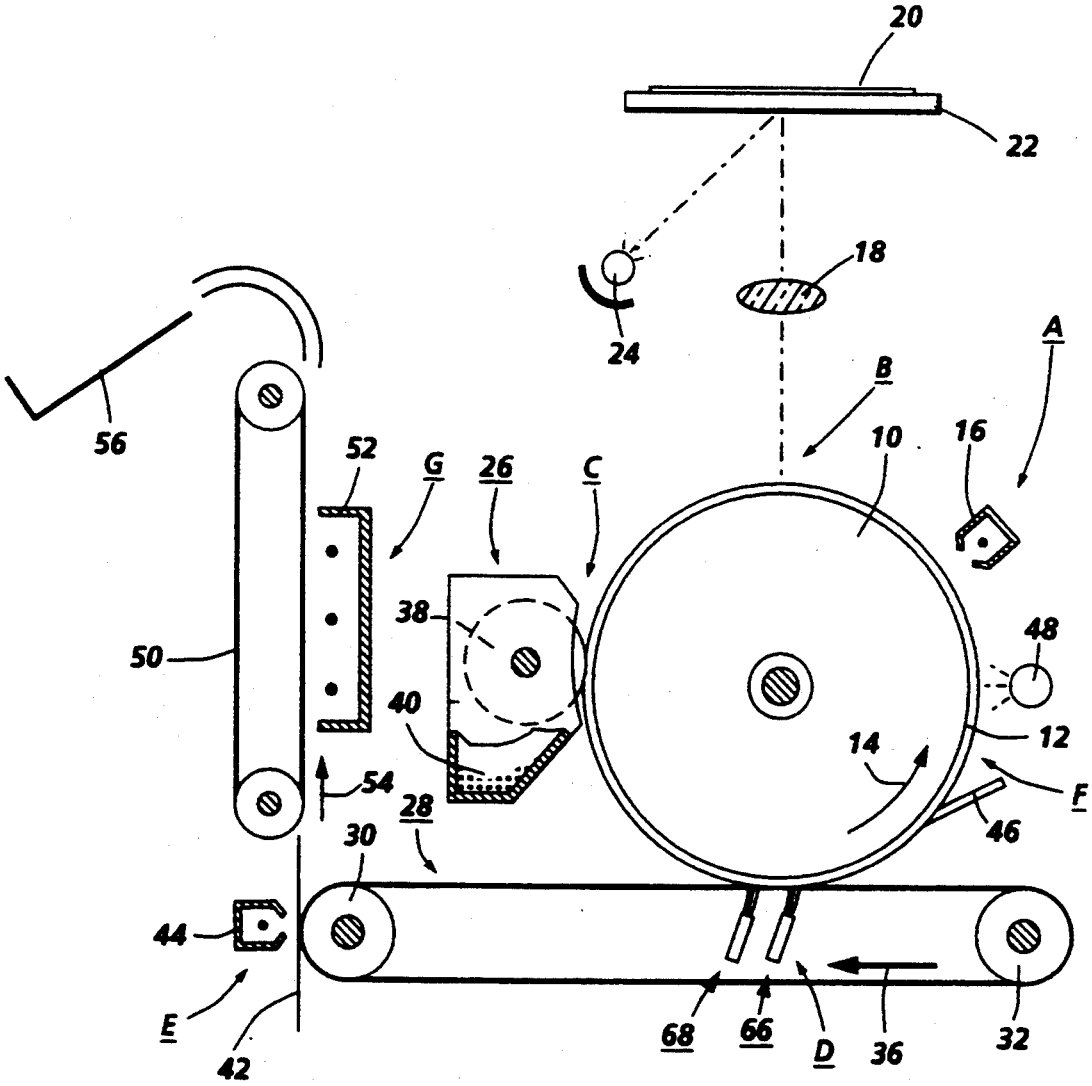
FIG. 5 is a schematic elevational view illustrating an exemplary electrostatographic printing machine incorporating the features of the present invention.

For a general understanding of an exemplary electrostatographic printing machine incorporating the features of the present invention, reference is made to FIG. 5 which schematically depicts the various components thereof. It will become apparent from the following discussion that the transfer assembly of the present invention is equally well-suited for use in a wide variety of electroreprographic machines, as well as a variety printing, duplicating and facsimile devices.

Moving initially to a description of FIG. 5, before describing the specific features of the present invention in detail, the electrophotographic copying apparatus employs a highly conductive drum 10 having a photoconductive layer 12 deposited thereon. The photoconductive layer 12 provides an image support surface mounted on the exterior circumferential surface of drum 10 and entrained thereabout. A series of processing stations are positioned about drum 10 which is driven in the direction of arrow 14 at a predetermined speed relative to the other machine operating mechanisms by a drive motor (not shown), to transport the photoconductive surface 12 sequentially through each station. Timing detectors (not shown) sense the rotation of drum 10 and communicate with machine logic to synchronize the various operations thereof so that the proper sequence of events is produced at the respective processing stations.

Initially, drum 10 rotates the photoconductive layer 12 through charging station A. At charging station A, a charging device which may include a corona generating device, indicated generally by the reference numeral 16, sprays ions onto photoconductive surface 12 producing a relatively high substantially uniform charge thereon.

Once charged, drum 10 is rotated to exposure station B where a light image of an original document is projected onto the charged portion of the photoconductive surface 12. Exposure station B includes a moving lens system, generally designated by the reference numeral 18, where an original document 20 is positioned face down upon a generally planar, substantially transparent, platen 22 for projection through the lens 18. Lamps 24 are adapted to move in timed coordination with lens 18 to incrementally scan successive portions of original document 20. In this manner, a scanned light image of original document 20 is projected through lens 18 onto the photoconductive surface of photoconductive layer 12. This process selectively dissipates the charge on the photoconductive layer 12 to record an electrostatic latent image corresponding to the informational areas in original document 20 onto the photoconductive surface of photoconductive layer 12. While the preceding description relates to a light tens system, one skilled in the art will appreciate that other devices, such as a modulated laser beam may be employed to selectively discharge the charged portion of the photoconductive surface to record the electrostatic latent image thereon.

After exposure, drum 10 rotates the electrostatic latent image recorded on the surface of photoconductive layer 12 to development station C. Development station C includes a developer unit, generally indicated by the reference numeral 26, comprising a magnetic brush development system for depositing developing material onto the electrostatic latent image. Magnetic brush development system 26 preferably includes a single developer roller 38 disposed in a developer housing 40. In the developer housing 40, toner particles are mixed with carrier beads, generating an electrostatic charge therebetween and causing the toner particles to cling to the carrier beads to form developing material. Developer roller 38 rotates and attracts the developing material, forming a magnetic brush having carrier beads and toner particles magnetically attached thereto. Subsequently, as the magnetic brush rotates, the developing material is brought into contact with the photoconductive surface 12, the electrostatic latent image thereon attracts the charged toner particles of the developing material, and the latent image on photoconductive surface 12 is developed into a visible image.

At transfer station D, the developed toner image is electrostatically transferred to an intermediate member or belt indicated generally by the reference numeral 28. Belt 28 is entrained about spaced rollers 30 and 32, respectively, being transported thereabout in the direction of arrow 36. Preferably, belt 28 contacts drum 10 to form a transfer nip where the developed image on photoconductive surface 12 is transferred onto belt 28. In the illustrated embodiment, a bias transfer brush 66 and a grounding brush 68 are provided for tailoring electrostatic fields in the transfer region. The details of the transfer process, and the specific features of the transfer apparatus of the present invention will be discussed in greater detail with reference to FIGS. 1–3.

As belt 28 advances in the direction of arrow 36, the toner image transferred thereto advances to transfer station E where copy sheet 42 is advanced, in synchronism with the toner particle image on belt 28, for transfer of the image to output copy sheet. Transfer station E includes a corona generating device 44 which sprays ions onto the backside of copy sheet 42 to attract the toner particles from belt 28 to copy sheet 42 in image configuration. It will be understood that various transfer devices or systems, including one similar to the transfer system of the present invention, can be implemented for utilization at transfer station E.

After the toner particles are transferred to copy sheet 42, the copy sheet advances on conveyor 50 through fusing station G. Fusing station G includes a radiant heater 52 for radiating sufficient energy onto the copy sheet to permanently fuse the toner particles thereto in image configuration. Conveyor belt 50 advances the copy sheet 42, in the direction of arrow 54, through radiant fuser 52 to catch tray 56 where the copy sheet 42 may be readily removed by a machine operator.

Invariably, some residual carrier beads and toner particles remain adhered to photoconductive surface 12 of drum 10 after transfer of the image to belt 28. These residual particles and carrier beads are removed from photoconductive surface 12 at cleaning station F. Cleaning station F includes a flexible, resilient blade 46, having a free end portion placed in contact with photoconductive layer 12 to remove any material adhering thereto. Thereafter, lamp 48 is energized to discharge any residual charge on photoconductive surface 12 in preparation for a successive imaging cycle.

The foregoing description should be sufficient for the purposes of the present application for patent to illustrate the general operation of an electrophotographic copying apparatus incorporating the features of the present invention. As described, an electrophotographic copying apparatus may take the form of any of several well known devices or systems. Variations of specific electrostatographic processing subsystems or processes may be expected without affecting the operation of the present invention.

Referring now specifically to FIG. 1, the transfer station of the present invention and the particular structure thereof will be discussed in detail. FIG. 1 provides an enlarged detailed view of transfer station D in a cross-sectional plane extending along the direction of motion of the photoconductive drum 10 and perpendicular to the intermediate transfer belt 28. A conventional transfer nip is formed at the point of contact between the photoconductive imaging surface of the photoconductive layer 12 of xerographic drum 10 and the intermediate transfer belt 28. The intermediate transfer belt travels through the nip, moving into and out of engagement with the imaging surface of drum 10 where the toner powder image thereon is transferred to the intermediate transfer belt 28. The curvature of the imaging surface of the drum 10 relative to the intermediate transfer belt 28 defines a transfer zone including a transfer nip as well as a pre-transfer nip air gap and a post-transfer nip air gap located adjacent to the transfer nip along the upstream and downstream sides thereof, respectively.

The intermediate transfer belt 28 comprises a transferred image support layer 62 supported on a laterally conductive resistive backing substrate 60. Transferred image support layer 62 may be comprised of a photoconductive material or an insulative substrate having a resistivity greater than $5\times10^{10}$ ohm-cm. Laterally conductive resistive backing substrate 60 comprises selective materials that permit substantial charge relaxation during transfer nip dwell time while having sufficient lateral resistance to allow different potentials to be applied along the length of the intermediate belt 28. In a preferred embodiment, where typical system parameters include process speeds of approximately 10 inches/-second and maximum current limitations on the order of 1 mA, a wide resistivity range between $10^7$ and $10^{11}$ ohms/square and having a volume resistivity less than approximately $10^{10}$ ohm-cm, provides sufficient resistivity. It has been found that carbon loaded polycarbonate materials can be produced to provide the desired results for the present invention. However, it will be understood that various materials and additives can provide suitable resistivity. For example, tetrahepthlammonium bromide (THAB) ionic additives have been used successfully as an additive to urethane based materials in fabricating bias transfer rolls having a specific resistivity. Ongoing work on materials for use in bias transfer rolls would likely disclose many alternative materials that would be applicable for use in the present invention. It is further noted that the intermediate transfer belt 28 of the present invention can be fabricated as a single layer structure so long as appropriate resistivity is provided.

In a conventional system, electrostatic image transfer from the xerographic drum 10 to the intermediate transfer belt 28 is typically accomplished by inducing an electrical transfer field at the transfer nip located at the point of contact between photoconductive surface 12 and the intermediate transfer belt 28. The electrical transfer field is typically generated by a conventional corona generating device or a bias transfer roll, as is well known in the art, and can be so provided in the present invention. In the preferred embodiment of the present invention, electrostatic image transfer to the intermediate transfer belt 28 is accomplished via a biased blade brush 66 coupled to biasing source 67. The biased blade brush 66 contacts laterally conductive resistive substrate 60 opposite the transfer nip to provide an applied potential difference between the intermediate belt 28 and the photoconductor drum 10. The applied voltage potential of the biased blade 66 in the transfer nip will be selected to create sufficiently high electrostatic fields of the appropriate polarity to cause transfer of the toner to the intermediate transfer belt 28. Typically, fields in the transfer nip that are above 20 volts/micron are necessary and frequently fields on the order of 40 volts/micron or higher are required, depending on such factors as toner adhesion, toner charge, toner mass to be transferred, etc.

It will be noted that a bias potential can be applied to the conductive substrate of drum 10 to provide a supplemental applied potential difference between the conductive substrate of drum 10 and the intermediate transfer belt 28 to enhance transfer field generation, as appropriate. In further discussion herein, the voltages on the conductive biased blade members acting on the intermediate belt 28 will be assumed to be referenced to the potential on the conductive substrate of drum 10, and the reference potential of the conductive substrate of drum 10 will further be assumed to be zero, strictly for convenience of further discussion. It will be appreciated by those of skill in the art that, although the present discussion refers to a "photoconductor drum" as the toner image bearing member, a photoconductor belt might also act as the image bearing member in this invention. It will be further appreciated that various other structures such as sufficiently conductive shim blades, brush rollers, spongy rollers, etc. can be used as an alternative to the blade brushes of the preferred embodiment.

Although the applied potential difference between the transfer nip blade brush 66 and the conductive substrate of drum 10 contribute to the generation of transfer fields, it will be recognized that any bound surface charge present on the photoconductor 12 surface and on the intermediate transfer belt 28 surface will also contribute to the fields created in and around the transfer zone. The relative contribution of the applied voltage terms and the surface charge related terms to the transfer fields can be readily described by the equation:

$$V_E = V_B + V_2 - V_3$$

which refers to an "effective applied potential" ($V_E$) for the system, as opposed to just the applied potentials. Thus, the equivalent applied potential $V_E$ at any position near the transfer system of the intermediate transfer system described herein is given by the sum of the potential $V_B$ along the laterally conductive resistive substrate 60 of the intermediate belt 28 at any position of interest and the difference between the potential difference $V_2$ across the overcoating layer 62 of the intermediate transfer belt 28 due to any surface charges present thereat and the potential $V_3$ that a non-contacting electrostatic voltmeter would measure above the drum 10 surface immediately prior to the transfer zone.

As shown in FIG. 1, the present invention also includes a pre-nip blade brush 68 coupled between a biasing source (a ground potential in the case of FIG. 1) and resistive substrate 60 for contact therewith in the pre-transfer nip region adjacent to the transfer nip. Biased blade brushes 66 and 68 provide a means for applying appropriate potentials to the transfer nip and in the pre-transfer region so that high transfer fields can be induced in and beyond the transfer nip while transfer fields can be reduced or eliminated in the pre-transfer region. A ground potential as illustrated in FIG. 1 in the pre-transfer nip is indicated on member 68 only for reference. In general, member 68 will preferably be biased and mechanically positioned relative to the transfer nip such that the effective applied potential, $V_E$, referred to previously, will be sufficiently low at large pre-nip air gaps (typically greater than 50 microns) to avoid toner transfer at these air gaps. Thus, electrostatic image transfer to the intermediate transfer belt 28 is accomplished by effectively eliminating pre-transfer fields in the pre-transfer nip region while generating relatively high transfer fields in the transfer nip. The inventive intermediate transfer belt structure 28 of the present invention, including laterally conductive resistive substrate 60, in combination with a pre-nip bias blade brush 68 and biased transfer nip charging brush 66 accomplishes the objective of rendering very high transfer fields in the transfer nip while minimizing or eliminating the transfer fields in the pre-nip region.

It will be recognized that a transfer nip charge polarity commensurate with the charge on the toner to be transferred to the intermediate transfer belt 28 is required. For example, if positively charged toner is used in the system then, by applying a negative charge in the transfer nip area opposite the positively charged toner, a transfer field will be generated in the transfer nip, thereby inducing toner transfer from the image bearing surface 12 to the intermediate belt 28. It will also be appreciated that the voltage output from bias source 67 can be varied relative to system parameters to provide appropriate results. It will be further appreciated that the charge polarity of the toner and that the polarities shown and intimated, are described for illustration purposes only such that the present description applies equally to systems using different polarity schemes.

Figure 3:
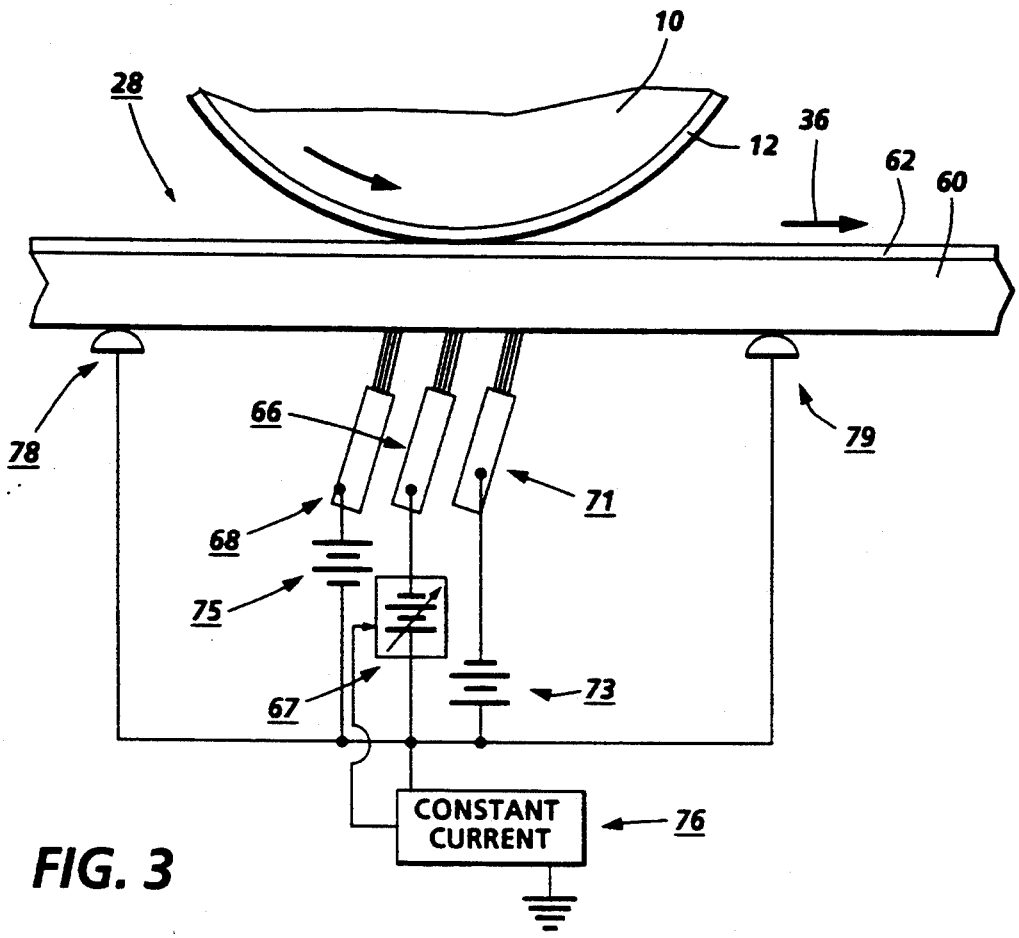
FIG. 3 is an enlarged schematic side view showing an alternative embodiment of the present invention showing a pre-transfer biasing device, a transfer nip biasing device, and a post-transfer biasing device.

An alternative embodiment of the present invention is shown in FIG. 3 where an additional biasing blade brush 71 is provided for contact with belt 28 opposite the post-transfer zone. Biasing blade brush 71 is coupled to a biasing source 73 to provide an applied potential difference between the intermediate transfer belt 28 and the photoconductor drum 10 in the post-transfer zone. This applied potential difference can be selected to enhance the transfer nip fields and optimize toner transfer in the transfer nip. In order to enhance the transfer nip fields, the polarity of the applied potential from biasing source 73 is similar to the polarity applied to transfer nip bias blade brush 66. Biasing source 73 is used to optimize the transfer fields during separation of the intermediate surface 62 from drum surface 12 in the post transfer zone. Choice of the potential delivered by biasing source 73 and the physical location of the biased blade brush 71 can be made to minimize the amount of post-nip air breakdown allowed at large air gaps (typically above 50 microns air gaps) while maintaining sufficiently high fields of low air gaps during the initial separation of the surface 62 from surface 12. High fields at the low air gap separation points (typically above 10 volts/micron at air gaps below 50 microns) avoid transfer loss of toner during separation. While most systems are very tolerant of even a high amount of post-nip air breakdown, prevention of a large amount of post-nip air breakdown, especially at large air gaps, can be desirable under certain conditions to avoid, for example, image degradation due to severe post-nip air breakdown. The post-nip bias source 73 can be used to optimize the fields during separation, depending on the transfer characteristics of the toner in the system.

In the alternative embodiment shown in FIG. 3, having a post-transfer bias brush blade 71, it may be preferable to connect the bias blade brushes 66, 68, 71 in a constant dynamic current configuration to buffer the voltage applied to each bias blade brush. Such a constant dynamic current configuration is provided by tying each biasing source 67, 73, 75 (in this embodiment, the pre-nip bias blade brush 68 is shown coupled to a biasing source 75, although the biasing source could also be a ground potential as shown in the previous embodiment of FIG. 1) to a common node which is further coupled to a constant current source 76. The constant current source 76 is further coupled back to the transfer nip biasing source 67. This constant dynamic current configuration is preferable since it provides a feedback loop to bias blade brush 66 which compensates for any potential on photoconductive surface 12 by eliminating the effect of current passing through the intermediate transfer belt 28 due to the lateral conductivity thereof.

The constant dynamic current configuration of the alternative embodiment shown in FIG. 3 may also include a pair of conductive elements 78, 79 for contacting the laterally conductive resistive layer 60 of intermediate transfer belt 28 along the periphery of the pre and post-transfer zones, respectively. These conductive elements may take the form of a conductive shoe (as shown), or any various conductive member which may be known to one of skill in the art, including rollers, conductive brushes, blades, etc. The conductive elements are further coupled to the constant current source 76. The additional conductive paths provided by conductive elements 78 and 79 allow for any current passing through the intermediate transfer belt 28, as a result of the lateral conductivity thereof, to be brought back to the constant current source 75. This configuration isolates the transfer zone from the rest of the system by preventing current along the intermediate transfer belt 28 from flowing beyond the periphery of the transfer zone.

It is noted that, in the regions adjacent to each biased brush blade along the surface of intermediate transfer belt 28, the potential will typically be approximately equal to the applied potential thereat. However, the voltage along the belt 28 between different biased blades will divide between the two different applied bias voltage values, depending on the lateral resistivity, the position, and the process speed of the transfer system. As an example, with reference to the previously described equation, a positive value for $V_2$ influences the fields in a manner substantially equivalent to a positive applied potential on a brush blade and a negative polarity will behave like an equivalent negative potential algebraically added to the applied potentials. Likewise, the voltage $V_3$ will influence the transfer fields between the drum 10 and the intermediate transfer belt 28 in a manner opposite the polarity sense of the voltages $V_B$ and $V_2$. For example, a positive value for $V_3$ will behave as an equivalent negative value for $V_B$ or $V_2$. In general, the equivalent applied potential can be made up of combinations of the potential due to surface or volume charge trapped on the photoconductor layers and any applied voltages on the drum 10. Thus, it will be appreciated that the equivalent applied potential $V_E$ defined by the equation above and referred to herein will comprise both applied voltage terms as well as surface charge terms.

Figure 2:
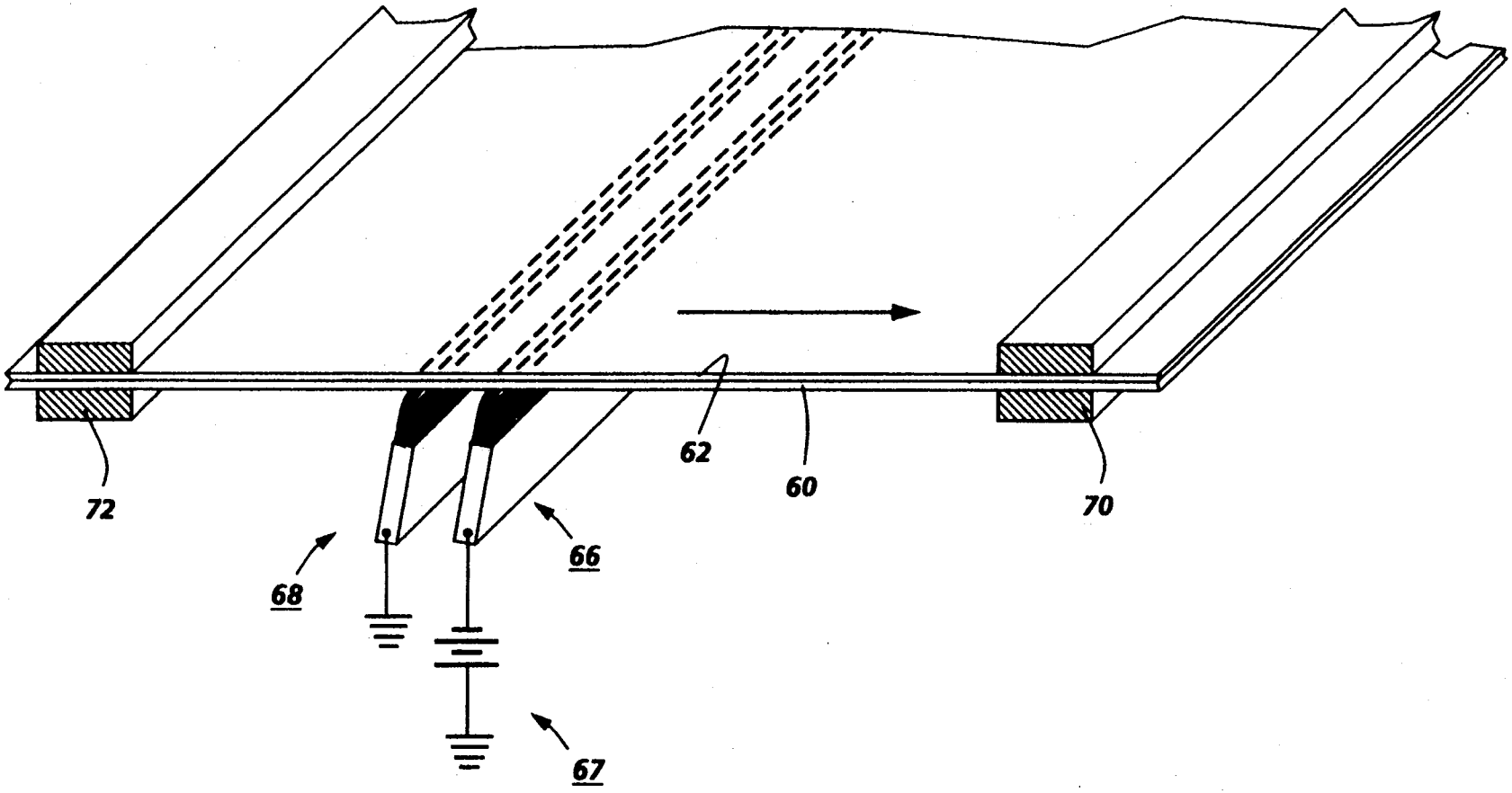
FIG. 2 is a perspective schematic showing the transfer assembly of FIG. 1.

FIG. 2 shows a perspective view of the intermediate transfer belt 28 passing through the transfer zone. It can be seen from this illustration that each bias blade brush 66, 68 is positioned substantially perpendicular to the intermediate transfer belt 28, providing a contact surface along the width thereof. Insulative support members 70 and 72 can also be provided for restricting belt deformation due to contact with drum 10 to the transfer region.

Figure 4:
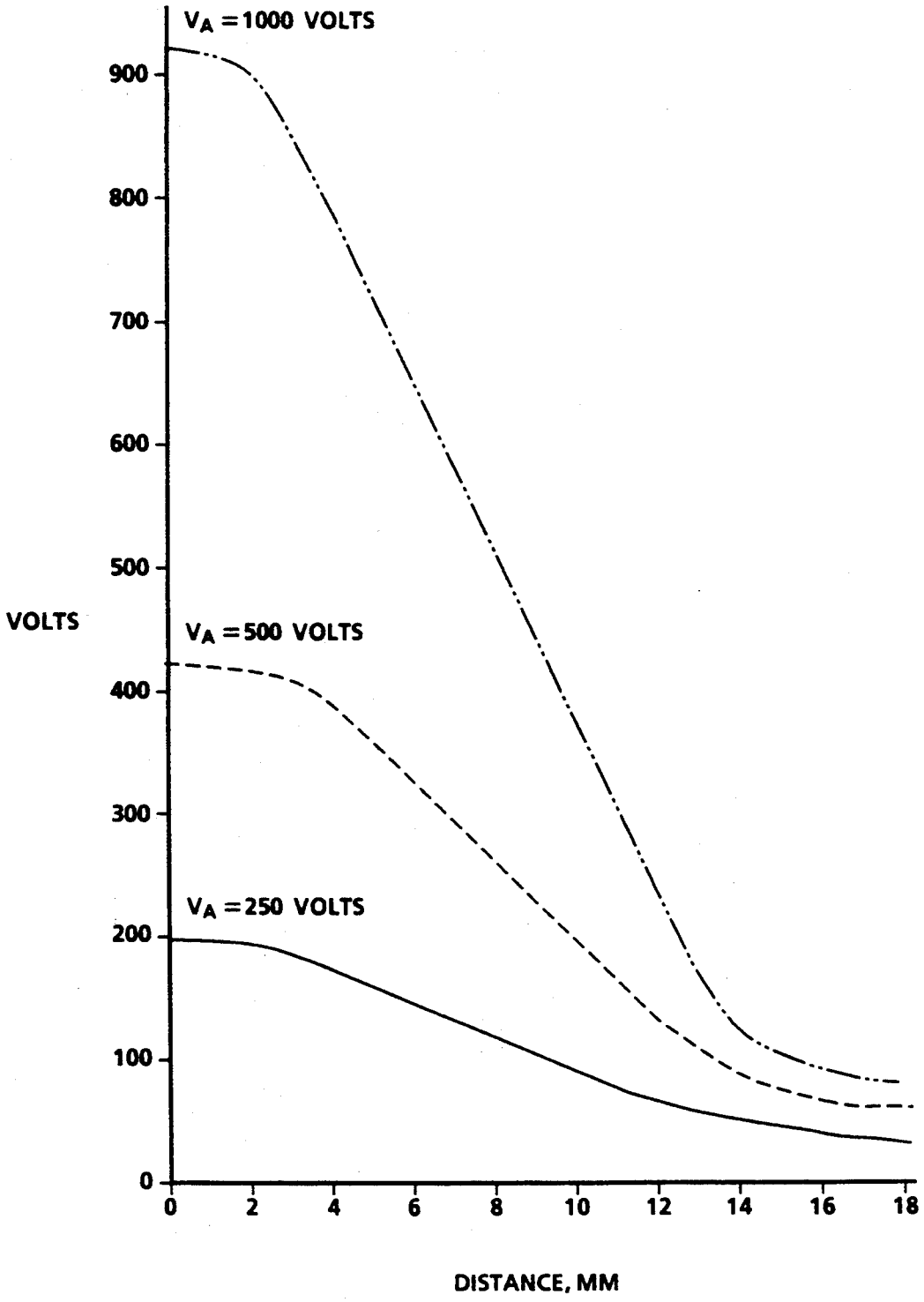
FIG. 4 is a graphic representation showing typical measured voltage drops along the transfer region as generated by the intermediate transfer belt system of the present invention.

FIG. 4 provides a graphical representation of the measured voltage on the drum 10 in a configuration as shown in FIG. 1, showing the voltage drop from the transfer nip biased blade brush 66 to the ground potential blade brush 68. In a system having typical system parameters as described herein, and having different applied voltages ($V_A$) ranging between 250 and 1,000 volts, as shown, the transfer system of the present invention can be expected to provide a voltage decrease in the pre-nip region with respect to distance from the transfer nip. It is apparent from this graphical representation, that the transfer field strength is greater in the transfer nip area as a result of the potential difference provided by bias blade brush 66, and that the fields in the pre-nip area are significantly weakened by the ground potential applied thereat. Thus, the present invention utilizes a laterally conductive resistive backed intermediate transfer belt to generate the desired high transfer fields in the transfer nip without the undesirable fields in the pre-transfer nip. The distance between the transfer nip blade brush and the ground potential blade brush can be selectively determined to provide desired results.

It will be appreciated that the the conductive substrate of drum 10 could be replaced by a laterally conductive resistive material wherein stationary conductive biasing electrodes similar to the conductive blade brush electrodes of the present invention could be positioned inside the drum 10 to provide the high transfer nip voltage/low pre-nip voltage results provided by the present invention. However, it is noted that the resistivity range for such a laterally conductive resistive drum configuration will typically be higher than the laterally conductive resistive belt of the present invention, due to the fact that the thickness requirements for a drum are much greater than the thickness of a belt. Typically, a belt will have a thickness of approximately 0.005 inches while a drum will have a thickness of approximately 0.05 inches.

As a further alternative, electrodes could be provided at selected positions along the laterally conductive resistive drum to provide appropriate voltages at different stations (i.e. development, charging, etc.).

In recapitulation, the electrophotographic printing apparatus of the present invention includes a toner transfer system having an intermediate transfer belt including a laterally conductive resistive substrate material. The intermediate transfer belt system includes a voltage biasing means for applying a charge in a transfer nip area to generate high transfer reversal fields therein and further includes a ground potential biasing means located in the pre-transfer region for applying a ground potential to the intermediate transfer belt thereat, causing a substantial decrease in the transfer field in the pre-transfer region.

It is, therefore, evident that there has been provided, in accordance with the present invention, an electrophotographic printing apparatus that fully satisfies the aims and advantages of the invention as hereinabove set forth. While this invention has been described in conjunction with a preferred embodiment thereof, it is evident that many alternatives, modifications, and variations will be apparent to those skilled in the art. Accordingly, the present application for patent is intended to embrace all such alternatives, modifications and variations as are within the broad scope and spirit of the appended claims.

I claim:

1. An apparatus for transferring charged toner particles from an image support surface to substrate comprising:

an intermediate transfer member positioned to have at least a portion thereof adjacent said image support surface in a transfer zone, defining a transfer nip, a pre-transfer zone, and a post-transfer zone;

means, located adjacent said pre-transfer zone, for applying a first bias voltage potential to said intermediate transfer member in said pre-transfer zone so as to minimize transfer fields therein for substantially preventing transfer of toner particles from the image support surface to said intermediate transfer member in the pre-transfer zone;

means, located adjacent the transfer nip, for applying a second bias voltage potential to said intermediate transfer member in said transfer nip so as to generate high transfer fields therein for attracting toner particles from the image support surface to said intermediate transfer member in said transfer nip;

means, located adjacent said post-transfer zone, for applying a third bias voltage potential to said intermediate transfer member in said post-transfer zone so as to optimize transfer fields therein for substantially minimizing air breakdown in said post-transfer zone;

a constant current source coupled to each said means for applying a first voltage potential, said means for applying a second voltage potential and said means for applying a third voltage potential for providing a constant current signal thereto; and at least one conductive element located peripherally adjacent said transfer zone and coupled to said constant current source for providing a conductive path from said intermediate transfer belt to said constant current source so as to electrically isolate said transfer zone on said intermediate transfer belt.

2. The apparatus of claim 1 further including at least one pair of insulative support members for receiving said intermediate transfer belt therebetween to provide support to said intermediate transfer belt.

3. The apparatus of claim 1, further including means for transferring the toner particles from said intermediate transfer member to a copy substrate in image configuration.

4. An electrostatographic printing apparatus including a transfer assembly for transferring toner particles from an image support surface to a substrate, said transfer apparatus comprising:

an intermediate transfer member positioned to have at least a portion thereof adjacent said image support substrate in a transfer zone, defining a transfer nip, a pre-transfer zone, and a post-transfer zone;

means, located adjacent said pre-transfer zone, for applying a first bias voltage potential to said intermediate transfer member in said pre-transfer zone so as to minimize transfer fields therein for substantially preventing transfer of toner particles from the image support surface to said intermediate transfer member in the pre-transfer zone;

means, located adjacent the transfer nip, for applying a second bias voltage potential to said intermediate transfer member in said transfer nip so as to generate high transfer fields therein for attracting toner particles from the image support surface to said intermediate transfer member in said transfer nip;

means, located adjacent said post-transfer zone, for applying a third bias voltage potential to said intermediate transfer member in said post-transfer zone so as to optimize transfer fields therein for substantially minimizing air breakdown in said post-transfer zone;

a constant current source coupled to each said means for applying a first voltage potential, said means for applying a second voltage potential and said means for applying a third voltage potential for providing a constant current signal thereto; and at least one conductive element located peripherally adjacent said transfer zone and coupled to said constant current source for providing a conductive path from said intermediate transfer belt to said constant current source so as to electrically isolate said transfer zone on said intermediate transfer belt.

5. The apparatus of claim 4, further including at least one pair of insulative support members for receiving said intermediate transfer belt therebetween to provide support to said intermediate transfer belt.

6. The apparatus of claim 4, further including means for transferring the toner particles from said intermediate transfer member to a copy substrate in image configuration.

* * * * *